United States Patent [19]

Speirs et al.

[11] 4,066,806

[45] Jan. 3, 1978

[54] DIFFUSION COATING OF FERROUS METALS

[75] Inventors: Kenneth K. Speirs, Universal City, Tex.; Robert P. Bradley, Tilburg, Netherlands

[73] Assignee: Chromalloy American Corporation, New York, N.Y.

[21] Appl. No.: 698,752

[22] Filed: June 22, 1976

[51] Int. Cl.[2] ..... C23C 11/02

[52] U.S. Cl. ..... 427/253; 428/653; 148/31.5; 415/200; 416/241 R; 427/383 D

[58] Field of Search ..... 427/253, 383 D; 29/196.2; 148/31.5; 416/241 R; 415/200

[56] References Cited

U.S. PATENT DOCUMENTS

| | | | |
|---|---|---|---|
| 3,096,160 | 7/1963 | Puyear | 427/253 X |
| 3,325,305 | 6/1967 | Schley et al. | 427/253 X |
| 3,689,615 | 9/1972 | Sandor et al. | 427/253 X |
| 3,764,373 | 10/1973 | Speirs et al. | 427/253 |
| 3,904,789 | 9/1975 | Speirs et al. | 427/253 |

*Primary Examiner*—Harry J. Gwinnell

*Attorney, Agent, or Firm*—Hopgood, Calimafde, Kalil, Blaustein & Lieberman

[57] ABSTRACT

A process is provided for the pack diffusion coating of ferrous metal articles with aluminum, wherein a small but effective amount of an energizer, aluminum chloride, is employed associated with a small but effective amount of a halide selected from the group consisting of an ammonium halide and an anhydrous metal chloride mixed in a pack containing particulate aluminum metal mixed with an inert material, e.g. refractory oxide, in which the ferrous article to be coated is embedded, the process being characterized by the fact that substantial outgassing of aluminum chloride is inhibited during the coating process by controlling in combination the total amount of halides employed not to exceed about 1 – ½% of the pack.

11 Claims, No Drawings

DIFFUSION COATING OF FERROUS METALS

This invention relates to the pack cementation diffusion coating of aluminum into the surface of ferrous metal articles, such as chromium-containing steels, embedded and heated in a diffusion coating pack, wherein substantial outgassing of aluminum chloride is inhibited while promoting the diffusion of aluminum. This invention is an improvement over U.S. Pat. Nos. 3,762,885 and 3,764,373.

STATE OF THE ART

The diffusion coating processes to which the invention relates include those in which the metal articles to be coated and protected against corrosion, e.g. turbine vanes, shrouds and the like, are embedded in a powder pack which contains particulate aluminum, usually an inert filler (such as powdered alumina), and a halide energizer for aiding the transport or transfer of the aluminum from the powdered pack to the surface of the articles to be coated. The pack with the embedded articles is heated in a closed retort (usually in the partial absence of oxygen) to relatively high temperatures for a sufficient time to produce the diffusion of the coating metal into the surface of the articles to a desired depth. Such processes are employed to enhance the oxidation resistance of the articles at elevated temperatures and to enhance erosion and corrosion resistance for a variety of purposes and uses. The conventional pack cementation diffusion coating techniques may require that the coating step be prolonged for many hours, or for even more than a day, at relatively high temperatures, usually in excess of 1200° F (650° C) and as high as 1800° F (982° C) to 2000° F (1093° C), depending upon the particular metal substrate, the thickness of coating desired and other characteristics.

There are a variety of metals and alloys the physical or mechanical properties of which tend to be altered or adversely affected when they are heated above, for example, 1000° F for any reason. Examples of such metals or alloys are precipitation hardenable stainless steels, such as 17-4PH (17% Cr, 4% Ni, 3% Cu, smaller amounts of Co, Mn, Si and the balance essentially iron), type 410 (11.5 to 13.5% Cr, 1% Si max, 1% Mn max, 0.15 carbon max and the balance essentially iron), and AMS 5616 (13% Cr, 2% Ni, 3% W and the balance essentially iron), among many others. The tempering temperature for the foregoing type of conventional precipitation hardenable steels may range from about 875° F (468° C) to about 1150° F (620° C). As will be apparent, diffusion coating temperature of over 1200° F (650° C) would have an adverse effect on the hardness of the steels to the extent of altering the physical properties and to the extent of rendering the articles unsuitable for use.

As a more specific illustration of commercial articles in which maintenance of physical properties during environmental use is an important and necessary requisite, attention is directed to certain components of the compressor portions of jet aircraft engines. These components are made of high strength steels so that they can withstand the tremendous mechanical stresses resulting from centrifugal force, thermal shock, and vibrations at temperatures which may range as high as 850° F (454° C) and not exceeding 900° F (482° C). While such temperatures are not considered high when compared to the elevated temperatures (1600° F to 1800° F or 871° C to 982° C) to which superalloy aircraft components are subjected, nevertheless the steel compressor components must be coated in order to protect the substrate metal in highly saline environments which prevail when low flying aircraft operate at or near the seashore, the atmosphere of which may also include substantial amounts of sand and coral dust which tend to be highly erosive. Thus, by providing a surface diffusion coating of aluminum which produces an iron-aluminum intermetallic compound on the steel substrate of the compressor component, which coating is galvanically sacrificial and at the same time resistant to dust erosion and/or saline corrosion, the component is capable of being used for relatively prolonged periods of time, provided that the original physical properties have not been substantially adversely affected by the coating process. This is particularly important in the case of those components which are shot peened in order to enhance their physical properties. As is well known, shot peening produces residual compressive loading into the metal surface which improves the high cycle fatigue performance of the components, and particularly enables the recovery of fatigue properties of previously corrosion damaged hardware.

Now, shot peening is effective only if subsequent processing temperatures do not relieve the required level of compressive stresses which may penetrate into the surface to a depth of as much as ten thousandths of an inch.

In U.S. Pat. Nos. 3,762,885 and 3,764,373, an improved pack diffusion method is disclosed for carrying out a pack diffusion process at a low temperature range of about 750° F (400° C) to 900° F (482° C), that is, below the temperature at which compressive stresses introduced into the surface of the steel substrate by shot peening, and/or the temper in the steel, tend to be degraded. In the method disclosed, aluminum trichloride is employed in the pack in an amount ranging by weight from about 1 to 5%, the pack comprising a mixture of particulate aluminum and powdered refractory oxide, such as alumina, the amount of $AlCl_3$ being preferably about 2 to 3% by weight of the pack.

By using the preferred amount of aluminum trichloride in the pack, the substantial outgassing of the chloride was utilized during the early part of the heating cycle to cleanse the surface of the steel part before it reached the diffusion temperature. While this process has been very successful on a commercial scale, the substantial outgassing of aluminum chloride presents the problem of pollution to the surrounding environment, due to the formation of the strong acid, HCl, by hydrolysis. To compensate for this problem, it was necessary to provide an expensive scrubbing system in order to meet the rather rigid EPA requirements.

Moreover, it was noted that the use of such high amounts of aluminum trichloride (2 to 3%) in the pack generally adversely affected the uniformity of the aluminum coating on stainless steels with relatively high chromium contents, e.g. 15% and above, such as AM-355 (15.5% Cr, 4.25% Ni, 2.75% Mo, 0.13% C, 0.12% N, less than 1% each of Mn, Si and the balance essentially iron), as compared to other 410 stainless steels with up to 12 to 13% chromium. The difficulties in producing a uniform coating on AM-355 are that, in normal production operations, it is difficult to obtain a coating having the desired surface texture. Coating roughness, in the case of turbine vanes, may adversely affect the aerodynamic properties of the airfoil surface.

We have found that we can avoid substantial outgassing of aluminum trichloride and also surface roughness of the final coating by employing a small but effective amount of $AlCl_3$ (less than 1%) in combination with a small but effective amount of ammonium halide (e.g. $NH_4Cl$) or an anhydrous metal chloride (e.g. $ZnCl_2$) in the pack. Thus, expensive scrubbing equipment need not be used in carrying out the improved process.

STATEMENT OF THE INVENTION

In its more preferred aspects, we provide a pack cementation process for diffusing aluminum into a ferrous article while inhibiting substantial outgassing of aluminum chloride fumes during the process which comprises, forming a dry aluminum pack containing by weight at least about 50% particulate aluminum metal, about ⅛ to ¾% of an ammonium halide or an anhydrous metal chloride together with a halide salt formulation comprising about ⅛ to ¾% $AlCl_3$, as the energizer material, the balance particulate inert refractory material, e.g. alumina, and maintaining said pack at a relative humidity ranging up to about 50%, the total $AlCl_3$ and halide salt content not exceeding about 1½%. The dry pack is then subjected to thermal pretreatment in a sealed retort at a temperature of about 750° to 900° F (400° to 482° C) for at least about 12 hours at said temperature. The pretreated pack is then subjected to at least one more thermal pretreatment by again mixing therewith the aforementioned halide salt formulation under said dry conditions and reheating said pack to a temperature in the range of about 750° to 900° F (400° to 482° C) for at least about 12 hours, thereafter mixing with said further pretreated pack said aforementioned halide formulation under said dry conditions, embedding the ferrous article to be coated in said pack and sealing said pack and embedded metal article in a steel retort, and then subjecting said pack and embedded article to a diffusion coating cycle by heating said pack to a diffusion coating temperature in the range of about 750° to 900 ° F (400° to 482° C) and maintaining said pack at said temperature until the desired aluminum coating thickness has been obtained.

The aforementioned preferred embodiment provides a pack in which outgassing of aluminum chloride is markedly reduced while maintaining optimum activity of the energizer at the low pack diffusion temperature.

The ammonium halide employed with $AlCl_3$ in the formulation is selected from the group consisting of $NH_4Cl$, $NH_4Br$, $NH_4I$ and $NH_4F$, $NH_4Cl$ being preferred. The anhydrous chloride salt is preferably selected from the group consisting of $ZnCl_2$, $CuCl_2$, $NiCl_2$, and $CoCl_2$, among others, $ZnCl_2$ being preferred.

Thus, summarizing the foregoing, the halide formulation comprises by weight of the pack about ⅛ to ¾% $AlCl_3$ with about ⅛ to ¾% of a halide salt other than $AlCl_3$ selected from the groups consisting of $NH_4Cl$, $NH_4Br$, $NH_4I$, $NH_4F$, $ZnCl_2$, $CuCl_2$, $NiCl_2$ and $CoCl_2$, the total of $AlCl_3$ plus the halide salt not exceeding about 1.5% by weight of particulate aluminum metal, and the balance essentially particulate inert refractory material, e.g. refractory oxide material, such as alumina.

The preferred range of the energizer is ¼ to ½% $AlCl_3$ and ¼ to ½% halide salt other than $AlCl_3$.

The aluminum trichloride-ammonium chloride combination is preferred. The halide formulation in small but effective amounts promotes the transfer of aluminum from the pack to the ferrous article, the promotor acting as a transport-inducing agent in that it triggers and sustains the cycle of aluminum transport from the pack to the substrate.

Although small amounts of energizer are used, relatively coarse particles of aluminum may be employed in the pack. This is desirable as it avoids explosion hazards. However, it is not to be construed that the invention cannot be employed with finer powders, such as −325 mesh aluminum, provided the necessary precautions are taken to avoid conditions which may cause explosions. Thus, while the pack has been stated as being essentially comprised of particulate aluminum, it is to be understood that the pack may comprise at least about 50% by weight of particulate aluminum, preferably at least about 60%, the balance being the energizer and an inert refractory oxide material. The aluminum as the essential constituent of the pack may range from about 60 to 95% by weight and the balance essentially the energizer and the inert material. Examples of inert materials are alumina, thoria, calcia, zirconia and other stable and inert refractory oxides and mixtures thereof.

While any aluminum particle size may be employed in the pack, we find it advantageous for our purposes to work at particle sizes larger than 200 mesh, more preferably, above 150 mesh, and generally from −60 mesh to +150 mesh. The inert material may have the same particle size range as aluminum and, generally speaking, we prefer that both the aluminum and the inert material be coarse because of ease of handling, mixing, and the like.

The more preferred aspects of the invention will be discussed relative to the use of aluminum chloride - ammonium chloride as the transport-inducing agent in the production of aluminum coatings on a precipitation hardenable stainless steel.

Tests conducted on a shot peened steel specimen of AMS 5616 steel (13% CR, 2% Ni, 3% W and the balance essentially iron) and AM 355 (15.5% Cr, 4.25% Ni, 2.75% Mo, 0.13% C and the balance essentially iron) indicated that the invention is particularly applicable to such steels without substantially adversely affecting the compressive stresses induced by shot peening, thus maintaining the fatigue reisitance level of the part and in some instances augmenting it to still higher levels because of the exceptionally good quality coating deposited on the steel part, particularly at higher chromium levels. In addition, the hardness of the part is maintained at relatively the same level.

In carrying out the process, it was found that the aluminum content of the pack could be varied from 95 to 50% or 60% and, with the balance inert material, preferably aluminum oxide. As stated earlier, the oxide has a mesh size which is similar to the aluminum particles, for example, −60 to +140 (U.S. Standard), but it has been found that the −325 mesh aluminum oxide can also be used. The dry aluminum chloride is added to the pack in the range of about ⅛ to ¾% together with ⅛ to ¾% $NH_4Cl$ as the preferred halide salt. Preferably about ¼ to ½% aluminum chloride and about ¼ to ½% $NH_4Cl$ are employed. Processing of the coating compound is desirably carried out under humidity control conditions with a relative humidity not exceeding 50% or, more advantageously, not exceeding 40%, to prevent undesirable reaction with moisture. The foregoing ranges of $NH_4Cl$ apply to the other halide salts set forth hereinbefore.

The thermal pretreatment of the pack is accomplished by heating a dry well mixed batch comprising aluminum, aluminum oxide, aluminum chloride and $NH_4Cl$ powders in a retort for times sufficient to expel any residual moisture in the aluminum or aluminum oxide. This pretreatment may be effected at about 750° F (400° C) to 900° F (482° C) for times of about 12 hours or longer at temperature. The foregoing pretreatment is repeated at least one more time with fresh additions of the $AlCl_3$-$NH_4Cl$ combination or other $AlCl_3$ halide salt combination. The pretreated batch of powder is then used for coating by simply adding dry aluminum chloride and ammonium chloride to it. Metal retorts of steel are used to hold the powder and the steel parts are completely embedded in the coating compound. The retort is covered with a lid and a gasket of asbestos or multiple layers of aluminum foil may be used to effect a seal between the lid and the retort body, the seal being sufficient to keep out air but permit any minor outgassing of halides that may occur. Shot peened hardware or items requiring minimal coating buildup can be processed at 795° F (425° C) for times of 24 hours or more.

Upon completion of the coating cycle, the retorts are removed and cooled in an area free of moisture, the relative humidity being 50% or less, e.g., less than 40%. When the coated parts are unpacked, any adhering powder is immediately blown off or rinsed off with water to prevent the possibility of reactions between the compound and the coating in the presence of moisture.

The heating cycle is carried out by placing the loaded metal retort in a relatively cold furnace and bringing the furnace up to the desired temperature. The retort is maintained at temperature for a time sufficient to form the desired aluminum coating thickness. Generally speaking, the time at temperature may range from about 10 to 30 hours, depending on the coating thickness desired. For example, a diffusion time at temperature of about 24 hours has produced a coating thickness of about 0.0005 inch.

Illustrative examples of the invention are as follows:

EXAMPLE 1

800 lbs. of −60+140 mesh aluminum are mixed with 200 lbs. of $Al_2O_3$ of also −60 +140 mesh size. To the 1000 lbs. of pack material, 5 lbs. of dry $AlCl_3$-$NH_4Cl$ promotor are added under a humidity not exceeding 40%, the promotor comprising 2.5 lbs. $AlCl_3$ and 2.5 lbs. $NH_4Cl$ which corresponds to about ¼% of each.

The pack is mixed in a vibrating blender for from 5 to 10 minutes. The charge is subjected to thermal pretreatment at 850° F (455° C) for 24 hours. The same pack, following the first pretreatment, is again mixed with ¼% $AlCl_3$ and ¼% $NH_4Cl$ and placed in the dry condition in an aluminum lined retort with the parts to be treated, such as compressor blades (e.g. AMS 5616 steel, AM 355, etc.), completely embedded in the pack. The cover is sealed to the retort body with multiple layers of aluminum foil in the form of a gasket sufficient to prevent air from getting in but to allow any minor outgassing to take place.

The retort is placed in an oven at ambient temperature and the temperature allowed to rise to the desired coating temperature by the application of heat, that is, to about 795° to 825° F (about 425° to 440° C) and the retort maintained at substantially that temperature range for about 30 hours.

Upon completion of the heating cycle, the retort is removed from the oven and allowed to cool approximately 400° F (204° C), after which it is placed in a dry environment for cooling to ambient temperature.

The cooled retort is then placed in a humidity control cabinet, the cover removed and the parts removed from the cementation pack. The parts are then cleaned of adhering coating compound by blowing with dry air and immersed in water to remove fine dust and other residues. The compressor blades produced in this manner exhibit a very clean deposit of aluminum.

EXAMPLE 2

The method of Example 1 is repeated except that the steel parts are made of 17-4PH stainless (17% Cr, 4% Ni, 3% Cu and the balance essentially iron). The pack is carefully prepared as described in Example 1 except that it is comprised of 60% by weight of −60 +140 mesh aluminum, 39% by weight of $Al_2O_3$ (−60 +140 mesh), with the energizer comprising ½% $AlCl_3$ and ½% if $ZnCl_2$ in each of the first and second pretreatment steps as described in Example 1. Following the second pretreatment step, ½% $AlCl_3$ and ½% $ZnCl_2$ are mixed with the pack and the steel parts embedded therein. The dry pack is maintained at a humidity of less than 40%. Substantially the same heating is employed as in Example 1, except that the retort is maintained at a temperature of about 775° F (413° C) for about 24 hours. The steel part produced in this manner has a uniform and clean coating of aluminum covering the surface thereof.

EXAMPLE 3

Maraging steels have excellent high strength in the age hardened condition. A nominal composition of one such steel is 18.5% Ni, 8.5% Co, 3.5% Mo, 0.03% C, 0.25% Ti, 0.15% Al and the balance essentially iron. This steel is substantially fully hardened by heating it at a temperature of about 900° F (482° C) for about 3 to 6 hours. Unfortunately, the steel does not have desirable resistance to oxidation at elevated temperatures. The method of the invention may be employed using an aluminum-$Al_2O_3$ pack comprising about 80% aluminum, about ¼% $AlCl_3$, about ½% $NH_4Cl$ and 19.25% alumina. The pack is subjected to thermal pretreatment twice at about 800° F with fresh additions of the foregoing energizer combination. Following the second pretreatment step, the pack is mixed with fresh additions of the same amount of energizer and the pack placed in the retort and the steel part embedded therein, the relative humidity being less than 40%. The retort with the embedded steel parts is heated from ambient temperature to 825° F (440° C) and maintained at that temperature for about 36 hours. This process produces a uniform coating comprised substantially of aluminum which markedly improves the resistance of the maraging steels to temperatures of up to 900° F while maintaining substantially its original hardness.

One of the advantages of the invention is that the cementation pack may be stored under conditions of relatively low humidity, e.g. below 50 or 40% humidity in plastic bags. One such composition comprises at least 60% aluminum, and the balance alumina over a particle size range of −60 to +150 mesh (U.S. Standard), the dry aluminum chloride and the halide salt (e.g. $NH_4Cl$) added to the mixture ranging from about ⅛ to ¾% of $AlCl_3$ and ⅛ to ¾% of halide salt by weight of the pack.

Various duplex energizer systems were evaluated, using the system ¼% $AlCl_3$-¼% $NH_4Cl$ as the preferred combination for reference.

The tests comprised aluminizing test specimens comprising a 410 stainless steel test coupon, a 410 stainless steel airfoil section, and an AM 355 airfoil section using the following systems:

1. ¼% $AlCl_3$ - ¼% $NH_4Cl$
2. ½% $AlCl_3$ - ¾% $NH_4Cl$
3. ½% $AlCl_3$ - ½% $NH_4Br$
4. ½% $AlCl_3$ - ½% $NH_4I$
5. ½% $AlCl_3$ - ½% $ZnCl_2$

The method of Example 1 was employed in carrying out the tests. Weight gains were measured for each test specimen in each coating energizer system. The coating cycles were repeated four times.

The weight gains were taken as indicative of coating thickness.

Average gain in weight on the 410 stainless steel airfoil section for the foregoing systems is given below:

| System No. | Weight Gain (mg)* |
|---|---|
| (1) | 64.3 |
| (2) | 36.7 |
| (3) | 71.1 |
| (4) | 60.5 |
| (5) | 75.3 |

*Average gain based on four coating cycles for each.

While good coatings were obtained in each test, it will be noted that System No. (2) exhibited less gain in weight (i.e. a thinner coating) as compared to reference System No. (1). This was also true in coating an airfoil section of AM-355 steel composition. Systems No. (3) and No. (4) were substantially comparable to reference System No. (1). As regards System No. (5) in which the halide salt is anhydrous zinc chloride, a slightly greater gain in weight was noted. The systems tested showed that there was suppression of noxious fuming as compared to the prior use of 2 to 3% $AlCl_3$, the amount of fuming tending to be more pronounced for the energizer system containing ¾% $AlCl_3$ by weight. Thus, the amount of $AlCl_3$ shoud not exceed about ¾%.

Additional tests have shown that using small amounts of $AlCl_3$ alone, e.g. ¾% by weight, in the pack does not provide the new and improved results in accordance with the invention as described hereinabove. Amounts of $AlCl_3$ used alone at 1% or lower under the same conditions as set forth for the invention did not prove reproducible results; there was lack of thickness uniformity; and, moreover, the intermetallic compound did not form uniformly in the coating. In the case of alloy AM-355, $AlCl_3$ alone had to be used well in excess of 1%. e.g. 2 to 3%, in order to get the desired coating, except that significant outgassing occurred which was very undesirable. When less than 1% $AlCl_3$ was used in the case of AM-355 alloy, the resulting surface was rough and dark areas were noted indicating that the coating did not completely cover the surface and indicating also that the coating was impoverished in the intermetallic compound (iron aluminide).

However, by using small but effective amounts of $AlCl_3$ not exceeding ¾% combined with not more than ¾% of the halide salt set forth herein, the foregoing problem as to significant outgassing was greatly inhibited and, moreover, consistently good coatings were obtainable.

While the invention has been particularly described with respect to protecting chromium-containing steels, such steels may contain 5 to 25% chromium, up to 5% tungsten, up to about 5% molybdenum, up to 5% nickel, up to 4% copper, up to 3% aluminum, up to 2% titanium, and the balance essentially iron, the compositions including, in particular, precipitation hardenable chromium-containing stainless steels.

As has been pointed out hereinbefore, a particular advantage of the invention is the relatively low temperature range over which high quality coatings can be achieved. Such low coating temperatures can range from 750° F (400° C) to 900° F (482° C) and, more advantageously, from about 775° F (413° C) to 850° F (455° C).

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

What we claim is:

1. A pack cementation process for diffusing aluminum into a ferrous metal article while inhibiting substantial outgassing of aluminum chloride fumes during said process which comprises the steps of:

forming a dry aluminum pack containing by weight at least about 50% particulate aluminum, about ⅛ to ¾% $AlCl_3$ combined with about ⅛ to ¾% of a halide salt selected from the group consisting of an ammonium halide and an anhydrous metal chloride as an energizer, the balance particulate inert material, and maintaining said pack at a relative humidity ranging up to about 50%, subjecting said dry pack to thermal pretreatment in a sealed retort at a temperature of about 750° to 900° F for at least about 10 hours at said temperature, subjecting said pretreated pack to at least one more thermal pretreatment by again mixing therewith said energizer under said dry conditions and reheating said pack to a temperature in said range of about 750° to 900° F for at least about 10 hours, thereafter again mixing with said further pretreated pack said energizer under said dry conditions the final total amount of said energizer not exceeding about 1½% by weight of said final pack, embedding the ferrous metal article to be coated in said pack and sealing said pack and embedded article in a steel retort, and then subjecting said pack and embedded article to a diffusion coating cycle by heating said pack to a diffusion coating temperature in the range of about 750° to 900° F and maintaining said pack at said temperature until the desired aluminum coating thickness has been obtained.

2. The process of claim 1, wherein the halide salt of said energizer is selected from the group consisting of $NH_4Cl$, $NH_4Br$, $NH_4I$, $NH_4F$ and the anhydrous metal chloride from the group $ZnCl_2$, $CuCl_2$, $NiCl_2$ and $CoCl_2$.

3. The process of claim 2, wherein the final $AlCl_3$ content of the pack ranges from about ¼ to ½%, the final halide salt content ranges from about ¼ to ½% and the amount of particulate aluminum is at least about 60% by weight, with the inert refractory material being a refractory oxide.

4. The process of claim 3, wherein the refractory oxide is alumina, and wherein the particle size of the pack material exceeds 200 mesh.

5. The process of claim 4, wherein the particle size of the pack material ranges from about −60 mesh to +150 mesh.

6. The process of claim 5, wherein the diffusion temperature ranges from about 775° to 850° F.

7. A pack cementation process for diffusion aluminum into a ferrous metal article while inhibiting substantial outgassing of aluminum chloride fumes during said process which comprises the steps of:

forming a dry aluminum pack containing by weight at least about 50% particulate aluminum, about $\frac{1}{8}$ to $\frac{3}{4}$% $AlCl_3$ combined with about $\frac{1}{8}$ to $\frac{3}{4}$% $NH_4Cl$ as an energizer, the balance particulate inert material, and maintaining said pack at a relative humidity ranging up to about 50%, subjecting said dry pack to thermal pretreatment in a sealed retort at a temperature of about 750° to 900° F for at least about 10 hours at said temperature, subjecting said pretreated pack to at least one more thermal pretreatment by again mixing therewith said energizer under said dry conditions and reheating said pack to a temperature in the range of about 750° to 900° F for at least about 10 hours, thereafter mixing with said further pretreated pack said energizer under said dry conditions the final total amount of said energizer not exceeding about $1\frac{1}{2}$% by weight of said final pack, embedding the ferrous metal article to be coated in said pack and sealing said pack and embedded article in a steel retort, and then subjecting said pack and embedded article to a diffusion coating cycle by heating said pack to a diffusion coating temperature in the range of about 750° to 900° F and maintaining said pack at said temperature until the desired aluminum coating thickness has been obtained.

8. The process of claim 7, wherein the final pack contains by weight at least about 60% particulate aluminum, about $\frac{1}{4}$ to $\frac{1}{2}$% $AlCl_3$, about $\frac{1}{4}$ to $\frac{1}{2}$% $NH_4Cl$ and the balance essentially inert refractory oxide.

9. The process of claim 8, wherein the refractory oxide is alumina, and wherein the particle size of the pack material exceeds 200 mesh.

10. The process of claim 9, wherein the particle size of the pack material ranges from about −60 mesh to +150 mesh.

11. The process of claim 10, wherein the diffusion temperature ranges from about 775° to 850° F.

* * * * *